US007066397B2

(12) United States Patent
Astachow et al.

(10) Patent No.: US 7,066,397 B2
(45) Date of Patent: Jun. 27, 2006

(54) FUEL INJECTION VALVE

(75) Inventors: Andrej Astachow, Regensburg (DE); Grit Krüger, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/809,128

(22) Filed: Mar. 25, 2004

(65) Prior Publication Data

US 2004/0195350 A1 Oct. 7, 2004

Related U.S. Application Data

(63) Continuation of application No. PCT/DE02/03628, filed on Sep. 25, 2002.

(30) Foreign Application Priority Data

Sep. 27, 2001 (DE) ..... 101 47 792

(51) Int. Cl.

| | |
|---|---|
| ***F02M 47/02*** | (2006.01) |
| ***F02M 59/00*** | (2006.01) |
| ***F02M 61/00*** | (2006.01) |
| ***F02M 63/00*** | (2006.01) |
| ***F02M 61/10*** | (2006.01) |

(52) U.S. Cl. ..... 239/88; 239/533.2; 239/533.11

(58) Field of Classification Search ..... 239/88–96, 239/533.2–533.12, 585.5

See application file for complete search history.

(56) References Cited

U.S. PATENT DOCUMENTS

| | | | | |
|---|---|---|---|---|
| 4,674,688 | A * | 6/1987 | Kanesaka | 239/533.8 |
| 5,899,389 | A * | 5/1999 | Pataki et al. | 239/533.2 |
| 6,189,817 | B1 * | 2/2001 | Lambert | 239/533.2 |

FOREIGN PATENT DOCUMENTS

| | | | |
|---|---|---|---|
| DE | 25 21 339 | A1 | 11/1976 |
| DE | 199 56 830 | A1 | 6/2001 |
| GB | 1 334 939 | | 10/1973 |
| WO | 01/02718 | A1 | 1/2001 |

OTHER PUBLICATIONS

PCT International Search Report PCT/DE02/03628.

* cited by examiner

*Primary Examiner*—David A. Scherbel
*Assistant Examiner*—Darren Gorman
(74) *Attorney, Agent, or Firm*—Baker Botts L.L.P.

(57) ABSTRACT

The invention relates to a valve, in particular a fuel injection valve for a high-pressure accumulator injection system of an internal combustion engine. Said valve comprises a valve body, provided with a valve body seat and a valve needle, guided over a guiding length in said valve body within a stationary circular cylindrical guiding surface and provided with a valve needle seat for controlling a spray orifice. According to the present invention, a pressure reservoir under high pressure, in the shape of an annular groove arranged coaxially in relation to the guiding surface, is provided in said valve body.

14 Claims, 2 Drawing Sheets

FUEL INJECTION VALVE

CROSS-REFERENCE TO RELATED APPLICATION

This application is a continuation of co-pending International Application No. PCT/DE02/03628 filed Sep. 25, 2002 which designates the United States, and claims priority to German application number DE10147792.9 filed Sep. 27, 2001.

TECHNICAL FIELD OF THE INVENTION

The invention relates to a valve, in particular a fuel injection valve for a high-pressure accumulator injection system of an internal combustion engine.

BACKGROUND OF THE INVENTION

With conventional fuel injectors for injection systems of internal combustion engines the fuel injection nozzle is typically controlled by means of a valve needle, which is arranged to form a moving seal within a guide in a valve body of an injection valve. The valve needle features a valve needle seat at its tip, which, together with a valve body seat of the valve body, opens or closes at least one spray orifice to the combustion chamber of the internal combustion engine. The at least one spray orifice is typically located in the area of the valve body seat.

With the pressures which arise, the sealing edges and passages in the fuel injector are subject to significant mechanical stress, which also varies greatly during operation. The sealing of the injection valve is therefore especially important, even with common-rail systems, since by contrast with conventional systems for periodic injection, these are permanently under system pressure in each case so that bad seals can lead to continuous injection.

A seal between the pressure chamber and the leakage chamber can only be made between spray valve body and axially moving spray valve needle by means of a sealing gap, since any type of conventional elastic seal would not be able to withstand the high pressure loads over the long term. The sealing gap must be manufactured very precisely in order to be able, even with variations in temperature and the resulting material expansions, to simultaneously guarantee smooth guidance of the valve needle and thereby the best possible sealing effect.

An additional problem is caused by the fact that, with a common-rail injector there is a valve control piston to control the valve needle present in addition to the valve needle of the injection valve, which is also sealed by a gap seal against the exhaust chamber. The result of constantly high pressure on a number of gap seals is a relative large volume of leakage which adversely affects the overall efficiency of the system. One way of avoiding this leakage is to reduce the guide play to a low figure of 1.5 to 2.5 μm between valve needle seat and valve body. A further measure consists of coating the needle in the area of its guide, in a form of plastic coatings for example. As large a guide length as possible (>10 mm) of the valve needle can also reduce leakage. The play in the guide is however limited by manufacturing tolerances and by the requirements of lubrication and the guide length by the maximum dimensions of the injector.

SUMMARY OF THE INVENTION

One aim of the invention is to minimize the leakage of a fuel injection valve of a high-pressure accumulator injection system.

This aim of the invention is achieved with a fuel injection valve in accordance with the high-pressure accumulator injection system of an to internal combustion engine, which features a valve body with a valve body seat and a valve needle with a valve needle seat guided over a guide length in the valve body within a stationary circular guiding surface for controlling a spray orifice, characterized in that in the valve body a pressure reservoir under high pressure in the shape of an annular groove, arranged coaxially to the guiding surface is provided.

With a valve, especially a fuel injection valve for a high-pressure accumulator injection system of an internal combustion engine, a valve body with a valve body seat as well as a valve needle guided within the valve body in a stationary circular cylinder guide surface over the guide length with a valve needle seat for controlling a spray orifice is provided. In accordance with the invention there is further provision for the presence of a pressure reservoir operating under high pressure in the shape of an annular groove arranged coaxially in relation to the guiding surface.

This inventive valve has the advantage of reduced leakage between the guiding surface in the valve body and a valve needle guide since the pressure reservoir under high pressure in the form of an annular groove causes an elastic deformation of the guiding surface of the valve body towards the valve needle guide. The elastic deformation reduces the seal gap between the valve needle guide and the guiding surface to a minimum and thus ensures greatly reduced leakage.

A preferred embodiment of the invention provides for the annular groove to be separated by a hollow-cylinder-shaped cutout in the wall of the guiding surface of the valve body. When the high pressures occur in the annular groove this wall section is subject to elastic deformation in the direction of the valve needle guide and thus ensures a reduction in fuel leakage.

Preferably the depth of the annular groove is least one 5th of the guide length of the valve needle guide, giving the benefit of a sufficiently long wall section that can be elastically deformed in the desired manner. The annular groove can however essentially be embodied deeper, for example up to half the guide length of the valve needle guide.

A preferred embodiment of the invention provides a hydraulic connection between the fuel inlet of a pressure chamber in the valve body and the annular groove, with the annular groove being under the full high pressure in the injection valve at all times. In this way the deformation of the wall section is simultaneously dependent on the fuel pressure present in the annular groove. This has the advantage that leakage which normally becomes greater at high pressure can be reduced by the sealing gap which simultaneously becomes less at high pressure.

The annular groove preferably has a thickness which is at least one fifth of the diameter of the guiding surface. Preferably the wall section between valve body and annular groove has a thickness which roughly corresponds to the thickness of the annular groove.

In summary the aspects of the invention are as follows. The leakage gap in the needle guide is separated from the annular groove by the wall section. The annular groove is connected by a connecting groove in the valve body to the high pressure bore. When pressure builds up in the injection system the same hydraulic pressure thus occurs in the annular groove as occurs in the pressure chamber of the injector. On the wall of the needle side (inner wall) there is only the leakage pressure which is smaller by an order of magnitude than the pressure in the high-pressure chamber and the annular groove. The pressure difference produced deforms the wall section and the gap in the needle guide is reduced to a minimum. Since the leakage through the needle guide is proportional to the width of the gap it is consequently reduced in the desired way.

BRIEF DESCRIPTION OF THE DRAWINGS

The invention is now explained in greater detail using exemplary embodiments which refer to the enclosed Figures. The diagrams show.

DETAILED DESCRIPTION OF THE PREFERRED EMBODIMENTS OF THE INVENTION

Figure 1:
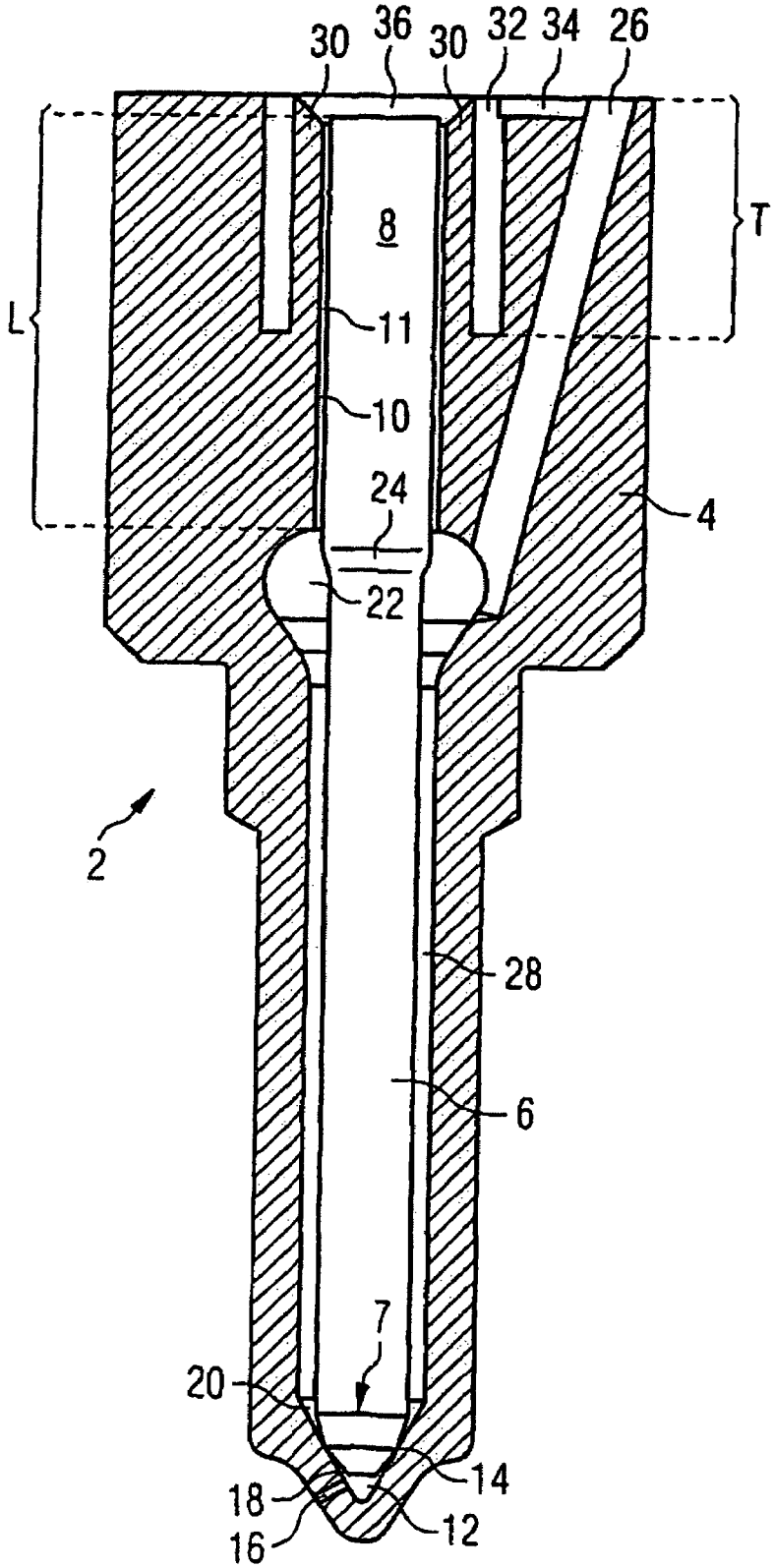
FIG. 1 a schematic cross sectional view of the fuel injection valve in accordance with the invention.

FIG. 1 shows a fuel injection valve in accordance with the invention in a schematic cross sectional view. The fuel injection valve 2 consists of a valve body 4 and a valve needle 6 which is guided sealed with a valve needle guide 8 within the valve body 4.

One or more spray orifices 16 are provided in a pocket hole 12 of the valve body 4. The valve needle 6 features a tip 7 with a seating edge 14 and a valve needle seat 18. This valve needle seat 18 sits on a valve body seat 20 thus seals the injection valve 2 with the spray orifices 16.

Via the fuel inlet 26 and a circular pressure chamber 22 lying between the valve needle 6 and the valve body 4 the fuel reaches the seat edge 14 and with valve needle 6 lifted, passes along the circular chamber 28 between valve needle 6 and valve body on via the pocket hole 12 and the spray orifice 16 into the combustion chamber of the internal combustion engine.

Between a cylinder-shaped valve needle guide 8 in the upper area of the valve needle 6, of which the diameter is enlarged in relation to the needle shaft and a guiding surface 10 in valve body 4 which features a cylindrical internal surface, there is a sealing gap 11. Through this sealing gap 11 the high pressure 22 obtaining in the pressure chamber is continually reduced in relation to a leakage area 36 above the valve needle 6.

Coaxially to the guiding surface 10 in valve body 4 there is provision for an annular groove 32 which has a rectangular cross section with a depth T. The depth T of the annular groove 32 amounts in the exemplary embodiment shown to approximately half a guide length L, which characterizes the length of the axial guide of the valve needle 6 with its valve needle guide 8 within the hollow-cylinder-shaped guiding surface. The guiding length L can typically be around 10 mm so that the depth T typically has a value of around 5 mm.

The depth T however amounts to at least one fifth of the guiding length of the valve needle guide 8, so that in this case the depth T has a value of around 2 mm.

The annular groove 32 is connected via a connecting groove 34 to the fuel inlet 26, so that the full fuel pressure is always present in the annular groove 32. In the upper area of the valve needle guide 8 or the sealing gap 11 the full fuel pressure is no longer present so that the hollow cylindrical wall section 30 between annular groove 32 and guiding surface 10 is elastically deformed inwards in the direction of the valve guide 8. In this way the sealing gap 11 is made smaller close to the leakage area 36, which reduces the fuel leakage through the sealing gap 11 overall.

Figure 2:
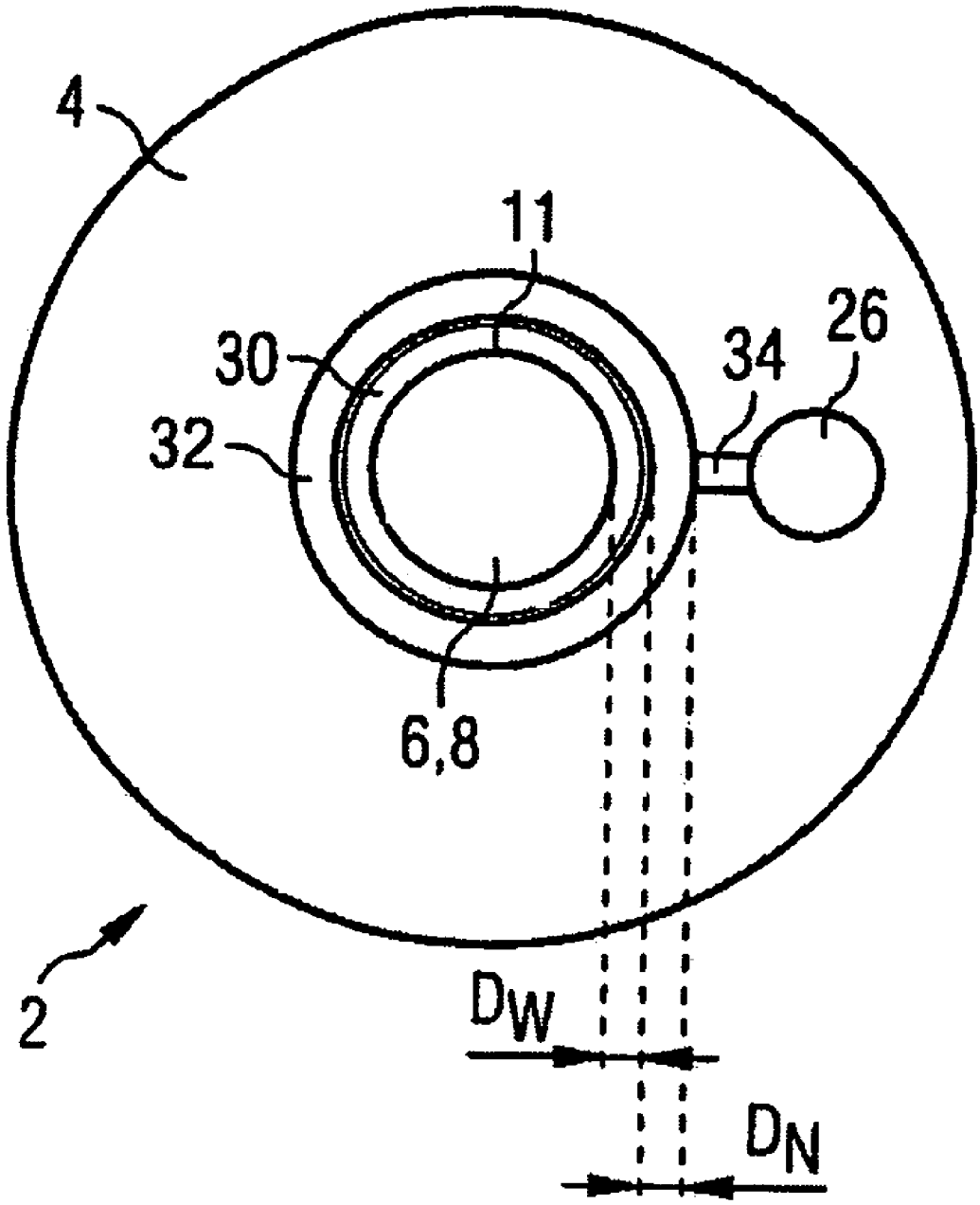
FIG. 2 a view from above of the fuel injection valve in accordance with FIG. 1.

FIG. 2 shows an overhead view of the fuel injection valve in accordance with FIG. 1. This diagram again clearly shows the circular-shaped contour of the annular groove 32. The thickness $D_N$ of the annular groove 32 can approximately correspond to the thickness $D_W$ of the wall section 30. Also visible in this drawing is the connecting groove 34 which provides a hydraulic connection between the fuel inlet 26 and the annular groove 32.

For a typical diameter of the valve needle guide 8 of 3.0 to 4.0 mm the thickness $D_W$ of the wall section 30 as well as the thickness $D_N$, of the annular groove 32 can be a value of around 1 mm in each case.

We claim:

1. A fuel injection valve for an injection system for an internal combustion engine, said valve comprising:

a valve body having a valve body seat, and a valve needle having a valve needle seat guided over a guide length (L) in the valve body within a stationary circular guiding surface for controlling a spray orifice, wherein the valve body includes a reservoir in the shape of an annular groove, said reservoir arranged coaxially to the guiding surface and separated from the guiding surface of the valve body by a cylinder-shaped wall section, wherein the wall section elastically deforms under pressure.

2. A valve in accordance with claim 1, wherein the reservoir has a depth (T) of at least one fifth of the guide length (L).

3. A valve in accordance with claim 1, further comprising a hydraulic connection between a fuel inlet of a pressure chamber in the valve body and the reservoir.

4. A valve in accordance with claim 1, wherein the reservoir has a thickness ($D_N$) of at least one fifth of the diameter of the guiding surface.

5. A valve in accordance with claim 1, wherein the wall section has a thickness ($D_W$), the reservoir has a thickness ($D_N$), and ($D_W$) and ($D_N$) are approximately equal.

6. A valve in accordance with claim 1, wherein the wall section is hollow.

7. A valve in accordance with claim 1, wherein the fuel injection system is a high-pressure accumulator injection system.

8. A valve in accordance with claim 1, wherein the reservoir is a high pressure reservoir.

9. A valve in accordance with claim 3, wherein the connection is adapted to maintain pressure in the reservoir.

10. A valve in accordance with claim 1, wherein the reservoir has a depth (T) of up to about half the guide length (L).

11. A valve in accordance with claim 1, wherein the diameter of the guiding surface is about 3 mm to about 4 mm.

12. A valve in accordance with claim 5, wherein the thickness ($D_W$) is approximately 1 mm.

13. A valve in accordance with claim 5, wherein the thickness of the reservoir is approximately 1 mm.

14. A valve in accordance with claim 1, wherein the reservoir has a depth (T) of about 5 mm.

* * * * *